US006179069B1

(12) United States Patent
Zheng

(10) Patent No.: US 6,179,069 B1
(45) Date of Patent: Jan. 30, 2001

(54) BREAKOUT CONTROL TO ENHANCE WELLBORE STABILITY

(75) Inventor: Ziqiong Zheng, Sugar Land, TX (US)

(73) Assignee: Baker Hughes Incorporated, Houston, TX (US)

( * ) Notice: Under 35 U.S.C. 154(b), the term of this patent shall be extended for 0 days.

(21) Appl. No.: 09/339,390

(22) Filed: Jun. 23, 1999

(51) Int. Cl.[7] ..... E21B 7/00; E21B 43/26; E21B 47/00

(52) U.S. Cl. ..... 175/65; 175/50; 175/72; 166/308

(58) Field of Search ..... 166/250.1, 308, 166/292; 175/48, 57, 50, 65, 72; 73/152.46

(56) References Cited

U.S. PATENT DOCUMENTS 3,907,034 * 9/1975 Suman, Jr. ..... 175/50
3,921,732 * 11/1975 Reynolds et al. ..... 175/50
4,879,654 * 11/1989 Bruce ..... 364/422
5,111,881 * 5/1992 Soliman et al. ..... 166/250.1
5,511,615 * 4/1996 Rhett ..... 166/250.1

* cited by examiner

*Primary Examiner*—David Bagnell
*Assistant Examiner*—Jennifer R. Dougherty
(74) *Attorney, Agent, or Firm*—Darryl M. Springs

(57) ABSTRACT

A method for encouraging breakout formation during the formation of hydrocarbon producing wellbores. Breakouts are encouraged during drilling operations to increase the stability of the formation rock immediately adjacent to the wellbore. The weight of drilling mud is selected to provide breakout control, and the path of the wellbore can be selected in directions to help breakout control. Efficient drilling operations are facilitated, and the resulting wellbore provides enhanced stability as hydrocarbon fluids arc produced from a subsurface reservoir into the wellbore interior.

17 Claims, 4 Drawing Sheets

BREAKOUT CONTROL TO ENHANCE WELLBORE STABILITY

BACKGROUND OF THE INVENTION

The present invention relates to the field of wellbores drilled through subsurface geologic formations. More particularly, the invention relates to controlled breakouts for enhancing borehole stability.

Wellbore stability significantly impacts the efficient drilling and production from hydrocarbon producing wells from subsurface geologic formations. As vertical and horizontal wellbores are drilled deeper and farther into geologic formations, integrated rock mechanics analysis assesses the risk of wellbore instability.

Wellbore "breakouts" are defined as the partial failure of the wellbore wall due to high stress concentrations. Breakout of the wellbore wall is conventionally considered to comprise wellbore failure because such breakout leads to wellbore blockage and uncontrolled wellbore enlargement. Conventional drilling practice seeks to minimize the maximum value of stress concentration on the borehole wall. This is accomplished by optimizing drilling trajectory and by circulating a heavy drilling mud through the wellbore. However, heavy mud weights can introduce hydraulic fracture and result in circulation losses through the formation, and can cause near wellbore impairment of the hydrocarbon producing formation.

Breakouts occur from a series of failures on the wellbore wall as stress concentration exceeds formation strength at that location. Known elastic equations model the stress distribution around a wellbore in an arbitrary stress field, where $\sigma$ and $\tau$ having subscripts r and $\theta$ represent the effective normal and shear stresses in a cylindrical coordinate system with z axis parallel to the drilling direction; $\sigma$ and $\tau$ having subscripts xx and xy represent the effective normal and shear stresses with a Cartesian coordinate system having the same z axis as the cylindrical system; r is the radial distance from the center of the wellbore and a is the borehole radius; and $\theta$ is the azimuthal angle measured from the x axis. Under elastic conditions, the maximum stress concentration occurs on the wellbore wall where r=a. The principal stresses at a location on the wellbore wall are described as:

$$\sigma_{\substack{tmax\\tmin}} = \frac{(\sigma_{\theta\theta}+\sigma_{zz})}{2} \pm \left(\frac{(\sigma_{\theta\theta}+\sigma_{zz})^2}{2} + \tau_{\theta z}^2\right)^{1/2}, \text{ and } \sigma_{\pi} \tag{1}$$

where $\sigma_{tmax}$ and $\sigma_{tmin}$ are the maximum and minimum effective principal stresses on the tangential plane of the wellbore wall. Failure occurs when the maximum principle stress exceeds the effective strength, as represented by:

$$\sigma_{tmax} \geqq \text{UCS} + \sigma_3 \tan^2(\pi/4+\phi/2) \tag{2}$$

wherein UCS is the unconfined compressive strength and $\phi$ is the internal friction angle of the rock.

Conventional practice for drilling a mechanically stable wellbore concentrates on reducing the maximum tangential stress on the wellbore wall to below the effective strength described as the converse of Equation (2). In-situ stress orientations, magnitudes, and rock strengths comprise parameters that cannot be controlled. Consequently, the factors conventionally controlled by an operator are drilling direction and the mud weight. For example, under normal stress conditions, when the vertical stress is the maximum stress, conventional drilling practice advocates for horizontal wells parallel to the minimum horizontal stress. This path is also identified as the direction yielding the lowest value of maximum tangential stress on the wellbore wall.

Conventional drilling practice seeks to avoid breakouts completely by reducing the maximum wellbore wall principal stresses. This is generally accomplished by increasing mud pressure until the value of the maximum wellbore wall stress is less than the strength of the formation. When drilling highly inclined or horizontal wells, effort is made to orient the wellbore in a direction to reduce the maximum wall stress.

Although this approach can generate a wellbore without breakout by minimizing the maximum value of tangential stress, this approach does not provide stability during production of hydrocarbon fluids. During open hole production, the bottom hole pressure is equal to or less than the near wellbore pore pressure, thereby removing the stabilizing effect of weighted drilling mud. The increase of mud pressure or drilling parallel to minimize horizontal stress (to minimize the maximum stress concentration) prevents breakout during drilling operations, however the removal of excess mud pressure during open hole production leads to breakout.

Accordingly, a need exists for new approach for drilling and maintaining the stability of a wellbore drilled through subsurface geologic formations.

SUMMARY OF THE INVENTION

The present invention provides a system for controlling wellbore shape and orientation through subsurface geologic formations. In one embodiment, the method comprises the steps of operating a drill bit through the geologic formations to create a wellbore having a wall formed by the geologic foundations, of determining a drilling fluid weight sufficient to prevent breakout of said wellbore wall, and of circulating a drilling fluid within the wellbore, wherein said drilling fluid has a weight less than the weight sufficient to permit breakout of the wellbore wall.

In another embodiment for reducing reservoir damage, a drill bit is operated through the geologic formations to create a wellbore having a wall formed by the geologic formations, a drilling fluid weight sufficient to prevent breakout of said wellbore wall is determined, a drilling fluid is circulated within the wellbore as the drill bit creates the wellbore, wherein said drilling fluid has a weight, less than the weight sufficient to permit breakout of the wellbore wall, so that breakout of the wellbore is controlled as the drill bit creates the wellbore; and fluid is produced into the wellbore from the hydrocarbon reservoir.

In another embodiment of the invention, a method for producing hydrocarbon fluids from a wellbore through subsurface geologic formations comprises the steps of operating a drill bit through the geologic formations to create a wellbore having a wall formed by the geologic formations, of determining the geologic formation composition at selected locations along the wellbore, of determining a drilling fluid weight sufficient to prevent breakout at a selected location along the wellbore, of circulating a drilling fluid within the wellbore as the drill bit creates the wellbore, wherein said drilling fluid has a weight, less than the weight sufficient to permit breakout of the wellbore wall, to control breakout of the wellbore at a selected location, and of producing the hydrocarbon fluids into the wellbore.

DESCRIPTION OF THE PREFERRED EMBODIMENTS

The invention provides a unique system for controlling wellbore shape and orientation through subsurface geologic formations. The system is based on known or projected information regarding in-situ formation stresses and strength.

Although it has been understood that breakout leads to a change in geometry and a redistribution of stress around the wellbore, it has been discovered that a stable wellbore geometry can be generated from breakout "failure", and from control over the breakout. This invention also depends on the discovery for wellbore formation and maintenance operations that breakouts are not necessarily synonymous with wellbore instability. Breakout image logs have been evaluated where the breakouts cover more than one-half of the entire wellbore circumference. Where the initial failure portion of the wellbore circumference is relatively large, such as 140 degrees covered by each breakout wing, the wellbore may collapse and not achieve a stable geometry. By controlling the amount of breakout, the allowance of modest breakout does not equal wellbore instability.

Figure 1:
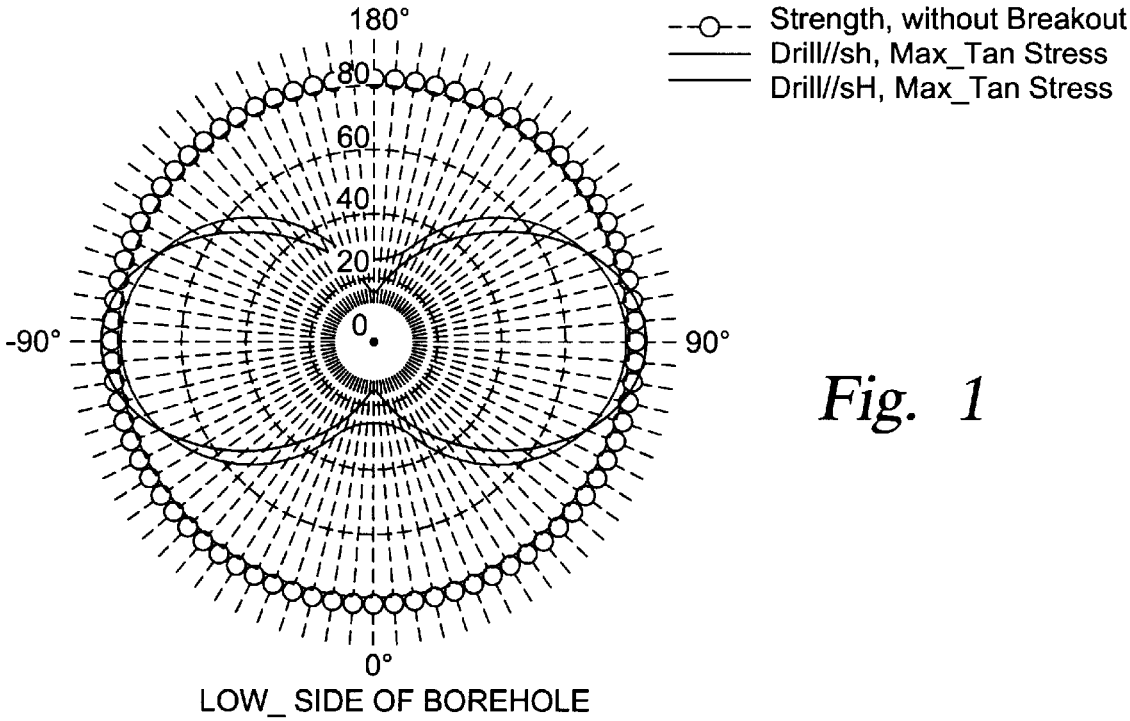
FIG. 1 illustrates azimuthal distribution of maximum tangential stress and compressive strength on a horizontal borehole w all when the mud weight is 1.32 gm/cc.
Figure 2:
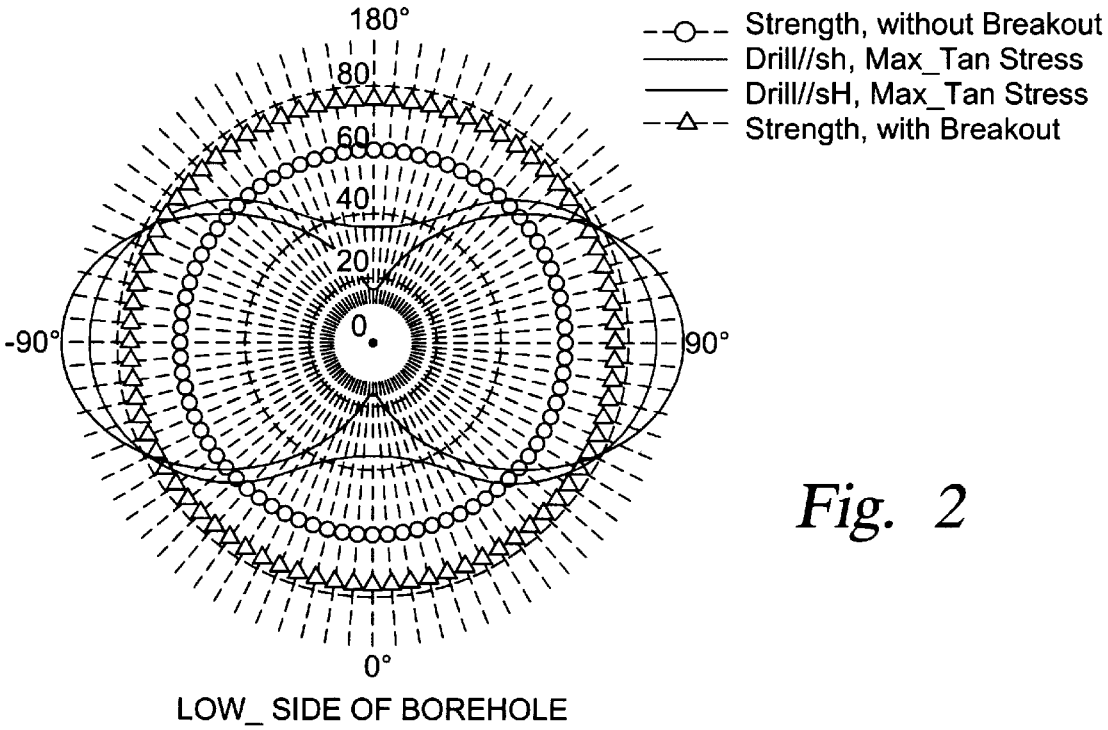
FIG. 2 illustrates azimuthal distribution of maximum tangential stress and compressive strength on a horizontal borehole wall when the bottom hole pressure equals the formation pore pressure during production.
Figure 3A:
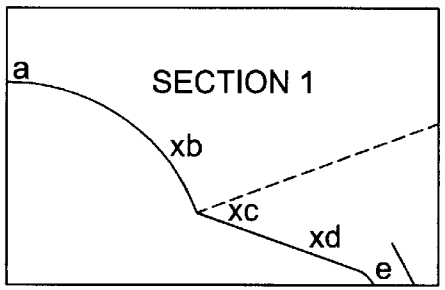
FIG. 3 illustrates changes in local principal stresses at selected positions relative to a wellbore perimeter during breakout formation.
Figure 3B:
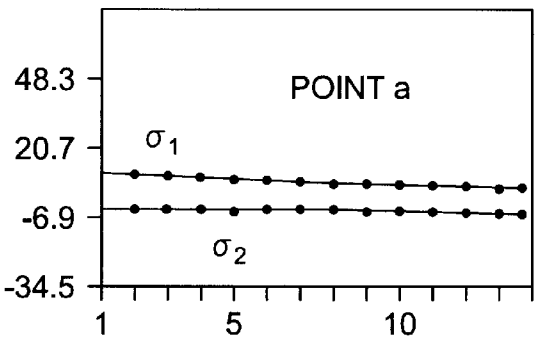
Figure 3C:
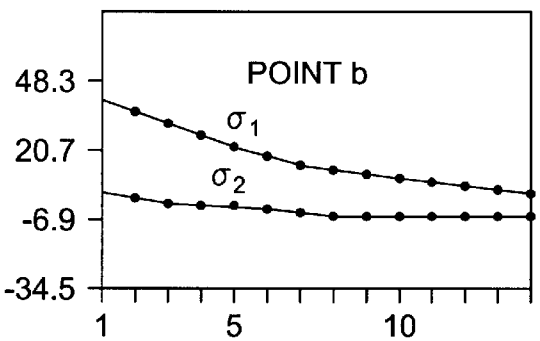
Figure 3D:
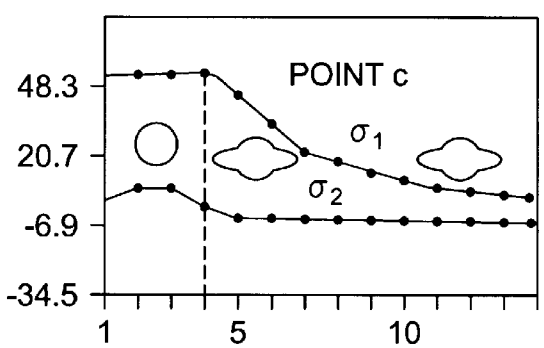
Figure 3E:
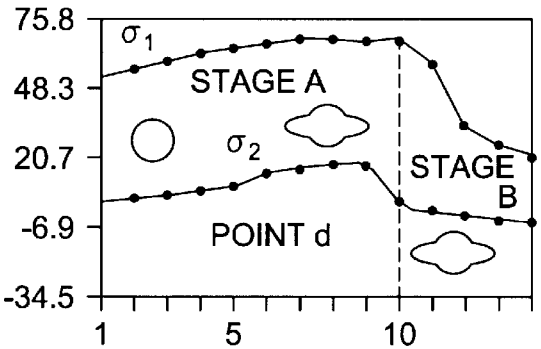
Figure 3F:
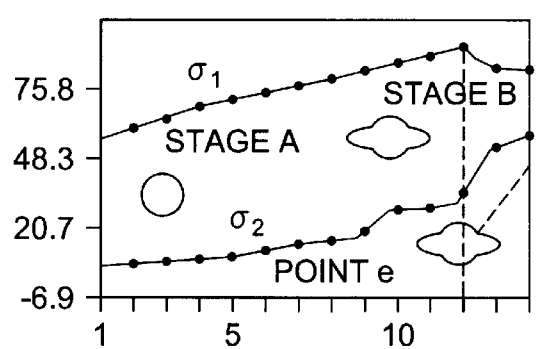

The invention resolves the differences between drilling and open hole production operations. FIG. 1 illustrates a horizontal drilling program assuming that the in-situ stresses are vertical and horizontal, with the maximum stress vertical. The maximum and minimum horizontal stresses are 55.2 MPa and 48.3 MPa respectively, the pore pressure is 31.7 MPa, and the unconfined strength is 58.6 MPa. FIG. 2 shows the same stress distribution as in FIG. 1, except that the mud pressure is equal to the pore pressure. The azimuthal distribution of the maximum tangential stress on the wellbore wall is shown in FIGS. 1 and 2 for wellbore directions parallel and perpendicular to the maximum horizontal stress $\sigma_H$. Conventional procedures specify a minimum mud pressure of 1.32 gm/cc for drilling perpendicular to $\sigma_H$ to prevent breakouts. Drilling parallel to $\sigma_H$ with the same mud weight results in a breakout approximating 30 degrees per wing, therefore requiring a mud weight of 1.4 gm/cc to prevent breakout. Under the conditions described in FIG. 2, a wellbore parallel or perpendicular to $\sigma_H$ would lead to a breakout size approximating 80 degrees or 96 degrees respectively.

It has been discovered through elastic analysis of stress redistribution around the wellbore during breakout formation, that stresses directly preceding the breakout increase. As the breakout becomes more stable, the stresses approach a quasi-hydrostatic condition. FIG. 3 illustrates changes in principal stresses near the wellbore during breakout formation. Except for the locations directly in front of breakout, all stresses decrease to levels lower than before the breakout.

To apply these principles to the examples illustrated in FIGS. 1 and 2, drilling perpendicular to the $\sigma_H$ is preferred when there are no other restrictions regarding hydrocarbon producing reservoirs within subsurface geologic formations. Drilling in this direction permits penetration of the maximum fracture density if the natural fractures are perpendicular to the existing minimum horizontal stress. The disadvantage of this drilling direction is that a 92-degree breakout for each wing is expected. If wellbore stimulation is needed to increase production efficiency, perpendicular hydraulic fractures and multiple fracturing may be required.

Drilling parallel to the maximum horizontal stress would require mud weight greater than 1.4 gm/ce to prevent breakout during drilling, and would result in 80 degrees breakout during production when the bottom hole pressure equals the pore pressure. This breakout is significantly smaller than for a perpendicular wellbore and provides greater wellbore stability. Drilling parallel to the maximum horizontal stress would also permit a single fracture parallel to the wellbore to be generated during stimulation.

By using a mud weight less than 1.4 gm/cc during drilling for this example, and by permitting a certain amount of breakout to occur, significant advantages can be realized. As illustrated in FIG. 1, a breakout of 30 degrees would be expected, and would not typically lead to severe drilling problems. Instead, this relatively modest breakout provides stabilizing and strengthening benefits for open hole production operations, compared with a conventional wellbore having no breakouts. The increase in wellbore strength will approximate 33%, and a single hydraulic fracture parallel to the borehole can be generated with fracturing operations.

Figure 4:
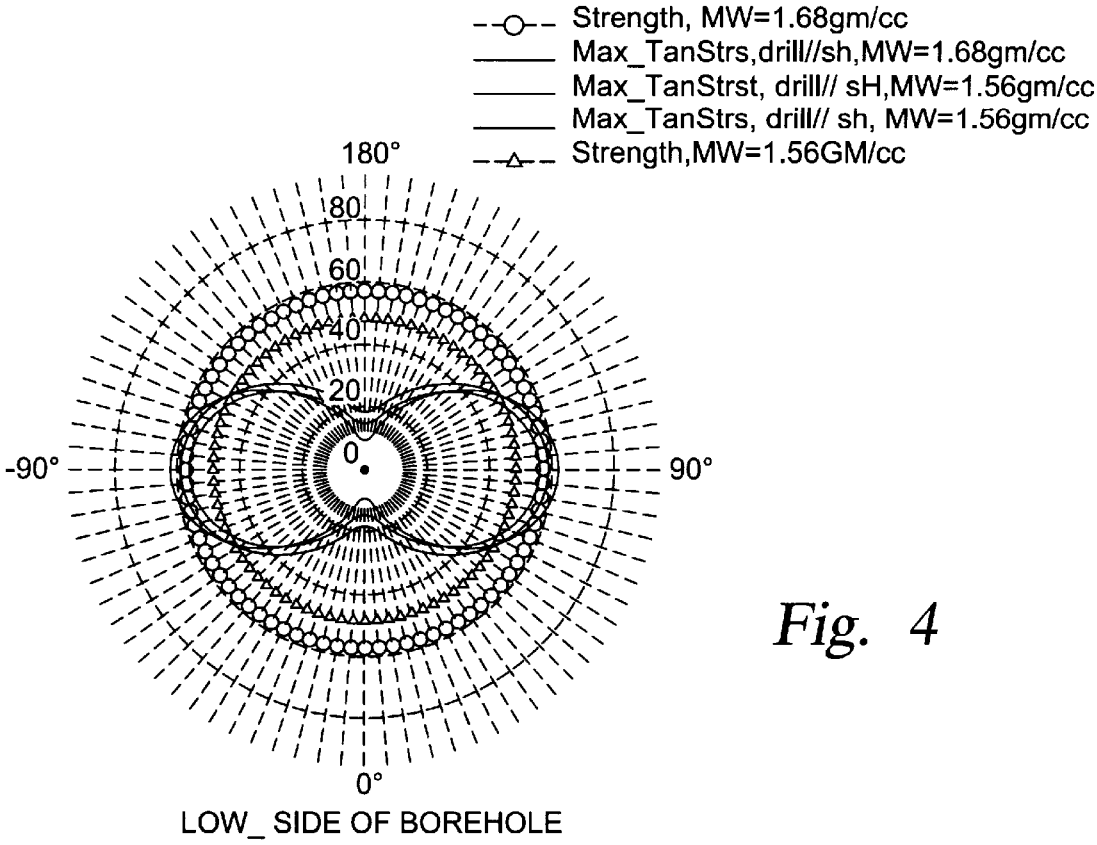
FIG. 4 illustrates azimuthal distribution of maximum tangential stress and compressive strength on a horizontal borehole wall, for parallel and perpendicular wellbores, when the mud weight is 1.68 gm/cc.
Figure 5:
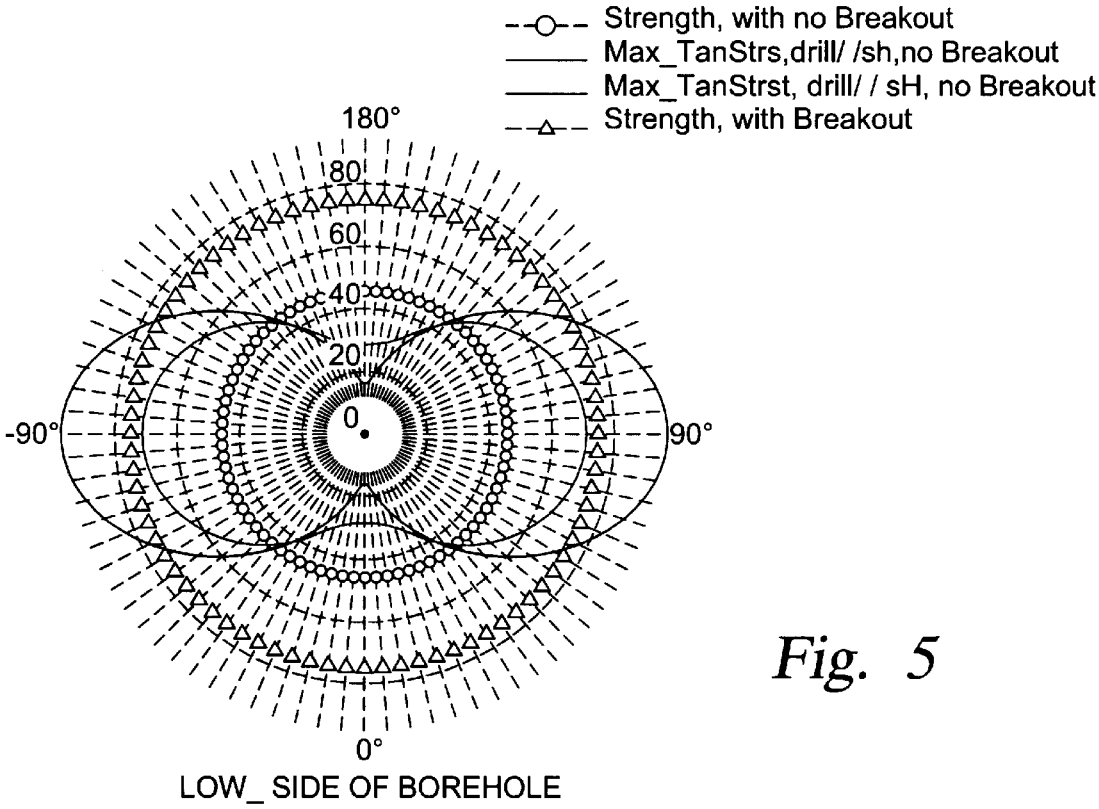
FIG. 5 illustrates azimuthal distribution of maximum tangential stress and compressive strength on a horizontal borehole wall parallel and perpendicular to the maximum tangential stress, when the bottom hole pressure equals the formation pore pressure during production.

FIGS. 4 and 5 illustrate examples of horizontal wellbore in an over-pressurized reservoir and anisotropic in-situ stress field. Reservoir pressure of 41.4 MPa is assumed, and the unconfined compressive formation strength is 31 MPa. The required mud weight to prevent breakout is 1.68 gm/cc for drilling perpendicular to and 1.7 gm/cc for drilling parallel to $\sigma_H$. Mud weights in this range for a low to mid strength sandstone can introduce severe formation damage, and would lead to wellbore instability under open-hole production operations. Breakout sizes of 130 degrees (perpendicular) and 100 degrees (parallel) would be expected for a conventional perpendicular or parallel wellbore, requiring expensive sand control mechanisms.

The invention pemits relatively modest breakout by using a mud weight less than the weight necessary to prevent breakout. A mud weight of 1.56 gm/cc could be used to accomplish breakouts of 70 degrees (perpendicular) or 67 degrees (parallel). The reduced mud weight significantly reduces potential formation damage, and a larger or smaller breakout could be accomplished by increasing or decreasing the mud weight. During open hole production, the ultimate wellbore strength is increased due to the breakout created. As previously described, drilling in a parallel direction permits generation of a single hydraulic fracture.

The invention provides superior results in directions either perpendicular or parallel to the maximum horizontal stress. Decisions regarding the orientation can be based on an integrated analysis instead on the limited objective of breakout prevention conventionally practiced. An integrated wellbore stability analysis and development plan can include the following steps alternatively or collectively performed.

In-situ stress information can be acquired through geological settings, known geology, core test results, and image log inversions. Rock mechanical properties can be obtained through prior experience, core test results, or log or statistically derived information. If the formation is naturally fractured, fracture orientations and the relationship of such orientations can be assessed.

The mud weight necessary to avoid breakout can be assessed with conventional techniques, and the minimum principal stress on the wellbore wall to determine the likelihood of drilling induced fractures. If the mud weight to prevent breakout falls within a reasonable range, the breakout potential from reducing the bottom hole pressure to the formation pore pressure can be examined. The direction of drilling can be evaluated to determine whether one direction will lead to a greater or smaller breakout than the other. Generally, it is expected that a horizontal wellbore parallel to $\sigma_H$ will cause smaller breakouts than a wellbore perpendicular to $\sigma_H$. An assessment can be performed to determine whether the preferred drilling direction will provide optimal stimulation conditions. In this analysis, if artificial fracturing is preferred, single fracture versus multiple fractures can be assessed.

If the required mud weight exceeds the level likely to cause formation damage, assessments can be made for selectively using breakouts to optimize competing criteria. As previously described, mud weight reductions can avoid induced fracturing and formation damage, and can provide significantly greater wellbore strength. The size of desirable breakouts can be assessed, and breakouts up to eighty degrees can provide the desired results. Decisions regarding drilling direction, mud weight, and other parameters can be derived from the evaluation of stimulation requirements, possible formation damage, and consequential wellbore strength caused by the breakouts. Such analysis can be performed in different sections of the wellbore, and may lead to different criteria for different wellbore sections. After each wellbore is drilled and completed, reservoir and wellbore performance can be assessed.

Figure 6:
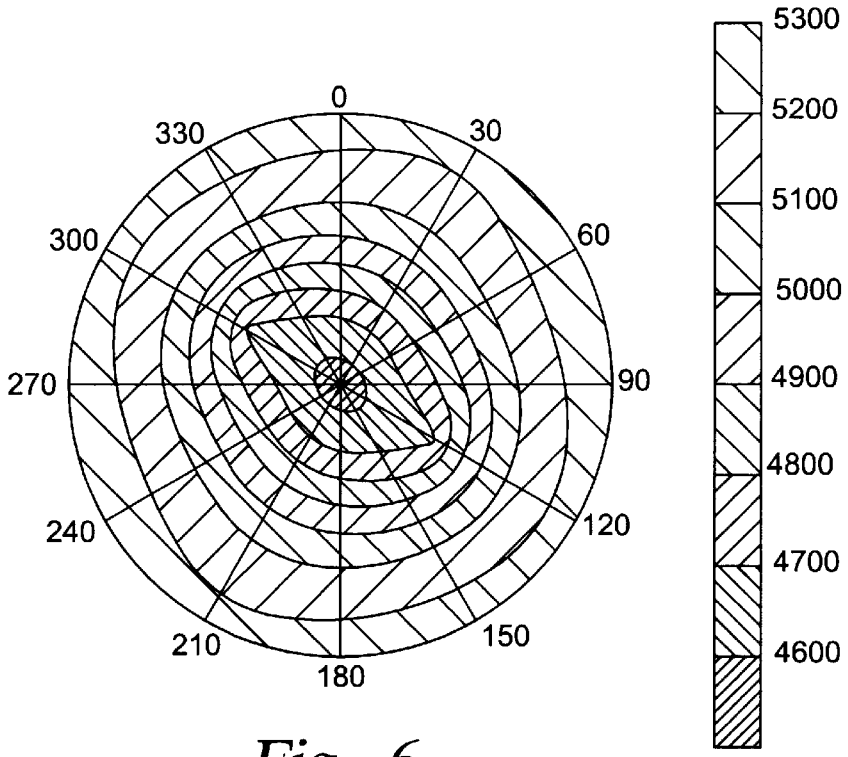
FIG. 6 illustrates mud pressure contours for 60 degrees of breakout, together with the drilling trajectory requiring the lowest mud pressure.
Figure 7:
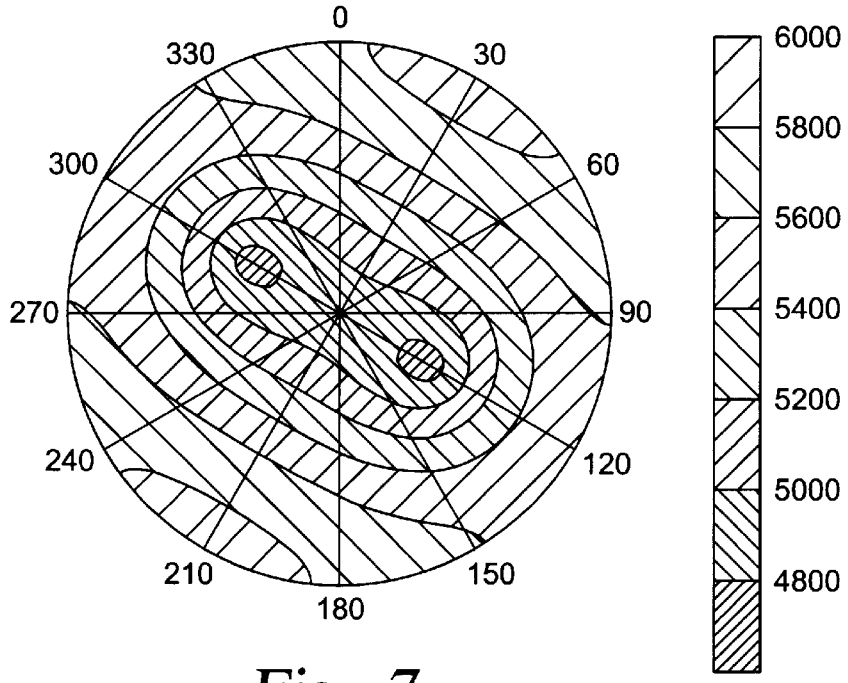
FIG. 7 illustrates mud pressure contours for zero breakout, together with the drilling trajectory requiring minimum mud pressure.

FIG. 6 illustrates the required mud pressure for allowing 60 degrees of breakout, together with the drilling trajectory requiring the lowest mud pressure. FIG. 7 illustrates the required mud pressure contours for zero breakout, together with the optimal drilling trajectory for minimum mud pressure. FIG. 7 shows that to maintain zero breakout, the required mud pressure is much greater than if 60 degrees breakout is allowed. As previously stated, greater mud pressure can lead to greater mud invasion and consequential formation damage.

By providing for a degree of breakout in wellbore formation and maintenance, improved wellbore stability will result. In horizontal wellbores, substantially less mud weight is required to maintain wellbore stability and less formation damage occurs. Assuming that the wellbore is drilled in the direction of maximum horizontal stress, the invention permits a single hydraulic fracture parallel to the wellbore instead of multiple fractures perpendicular to the wellbore. As a vertical or inclined wellbore is drilled, the mud weight can be less than required for conventional drilling operations which seek to maintain zero breakout. The amount of mud savings depends on the breakout size sufficient to maintain wellbore stability during drilling and open hole production phases. Instead of running expensive liners through long horizontal branch wellbores, significant liner expense can be avoided. The cost savings during drilling and completions, and the potential savings during production, provide significant efficiency and cost savings over conventional systems.

Although the invention has been described in terms of certain preferred embodiments, it will become apparent to those of ordinary skill in the art that modifications and improvements can be made to the inventive concepts herein without departing from the scope of the invention. The embodiments shown herein are merely illustrative of the inventive concepts and should not be interpreted as limiting the scope of the invention.

What is claimed is:

1. A method for drilling a wellbore through subsurface geologic formations, comprising the steps of:

operating a drill bit through the geologic formations to create a wellbore having a wall formed by the geologic formations;

determining a drilling fluid weight sufficient to prevent breakout of said wellbore wall; and circulating a drilling fluid within the wellbore, wherein said drilling fluid has a weight less than the weight sufficient to prevent breakout of the wellbore wall.

2. The method as recited in claim 1, further comprising the step of determining the maximum horizontal stress for a selected path segment through the geologic formations.

3. The method as recited in claim 2, further comprising the step of creating the wellbore perpendicular to said selected path segment.

4. The method as recited in claim 2, further comprising the step of creating the wellbore parallel to said selected path segment.

5. The method as recited in claim 1, further comprising the step of selecting drilling fluid weight sufficient to restrict breakout to eighty degrees or less.

6. The method as recited in claim 1, further comprising the step of producing formation fluids into the wellbore from the geologic formations.

7. The method as recited in claim 1, further comprising the step of selecting the wellbore path through the geologic formations, and the weight of the drilling fluid, to achieve a selected breakout amount along a selected wellbore segment.

8. The method as recited in claim 7, further comprising the step of changing the drilling fluid weight as the wellbore is being created to change the amount of breakout generated along another selected wellbore segment.

9. A method for limiting hydrocarbon reservoir damage adjacent a wellbore through geologic formations, comprising the steps of:

operating a drill bit through the geologic formations to create a wellbore having a wall formed by the geologic formations;

determining a drilling fluid weight sufficient to prevent breakout of said wellbore wall;

circulating a drilling fluid within the wellbore as the drill bit creates the wellbore, wherein said drilling fluid has a weight less than the weight sufficient to prevent breakout of the wellbore wall, so that breakout of the wellbore is controlled as the drill bit creates the wellbore; and producing fluid into the wellbore from the hydrocarbon reservoir.

10. The method as recited in claim 9, further comprising the step of fracturing the geologic formations before the fluid is produced into the wellbore.

11. The method as recited in claim 10, further comprising the steps of determining the maximum horizontal stress for a selected path segment through the geologic formations, and of creating the wellbore parallel to said selected path segment.

12. The method as recited in claim 11, further comprising the step of creating a single hydraulic fracture parallel to the wellbore.

13. The method as recited in claim 9, further comprising the steps of assessing the composition of the geologic formations and of selecting the drilling fluid weight to control the amount of breakout from the geologic formations.

14. A method for producing hydrocarbon fluids from a wellbore through subsurface geologic formations, comprising the steps of:

operating a drill bit through the geologic formations to create a wellbore having a wall formed by the geologic formations;

determining the geologic formation composition at selected locations along the wellbore;

determining a drilling fluid weight sufficient to prevent breakout at a selected location along the wellbore;

circulating a drilling fluid within the wellbore as the drill bit creates the wellbore, wherein said drilling fluid has a weight less than the weight sufficient to prevent breakout of the wellbore wall, to control breakout of the wellbore at a selected location; and producing the hydrocarbon fluids into the wellbore.

15. The method as recited in claim 14, further comprising the step of fracturing the geologic formations before the hydrocarbon fluids are produced into the wellbore.

16. The method as recited in claim 14, further comprising the steps of determining the maximum horizontal stress for a path segment through the geologic formations, and of creating the wellbore parallel to said selected path segment.

17. The method as recited in claim 16, further comprising the step of creating a single hydraulic fracture parallel to the wellbore.

* * * * *